US012385249B2

(12) United States Patent
Chiti

(10) Patent No.: US 12,385,249 B2
(45) Date of Patent: Aug. 12, 2025

(54) PREFABRICATED MODULE FOR OBTAINING A WALL FOR CLADDING BUILDINGS

(71) Applicant: Manni Green Tech S.r.l., Verona (IT)

(72) Inventor: Claudia Chiti, Verona (IT)

(73) Assignee: MANNI GREEN TECH S.R.L., Verona (IT)

( * ) Notice: Subject to any disclaimer, the term of this patent is extended or adjusted under 35 U.S.C. 154(b) by 187 days.

(21) Appl. No.: 17/903,424

(22) Filed: Sep. 6, 2022

(65) Prior Publication Data

US 2023/0183968 A1 Jun. 15, 2023

(30) Foreign Application Priority Data

Sep. 6, 2021 (IT) ..... 102021000022973

(51) Int. Cl.
*E04B 2/96* (2006.01)

(52) U.S. Cl.
CPC ..... *E04B 2/967* (2013.01)

(58) Field of Classification Search
CPC ..... E04B 2/967
See application file for complete search history.

(56) References Cited

U.S. PATENT DOCUMENTS 3,071,215 A * 1/1963 Gall ..... E04B 2/96 52/456
10,711,514 B2 * 7/2020 Koster ..... E06B 3/9616
2009/0199498 A1 * 8/2009 Ting ..... E04B 2/90 52/302.1
2019/0093349 A1 * 3/2019 LeVan ..... E04B 2/885
2020/0032575 A1 * 1/2020 Koster ..... E06B 3/9616
2024/0344333 A1 * 10/2024 Kreysler ..... B32B 3/30

FOREIGN PATENT DOCUMENTS

KR 0171872 B1 * 2/1999
KR 20110090363 A * 8/2011

OTHER PUBLICATIONS

UNI EN 13830 (EN 13830, 2015), https://standards.iteh.ai/catalog/standards/cen/1b35a148-d56e-4624-9a9e-d066defda108/en-13830-2015a1-2020, Dec. 6, 2021, Retrieved Sep. 6, 2022.

* cited by examiner

*Primary Examiner* — Joshua K Ihezie
(74) *Attorney, Agent, or Firm* — Tutunjian & Bitetto, P.C.

(57) ABSTRACT

The present invention relates to a prefabricated or pre-assembled module for obtaining an external wall for cladding buildings or for obtaining a curtain wall, including:
at least one sandwich panel,
at least one edge profile,
at least one gasket.

21 Claims, 11 Drawing Sheets

FIG.1
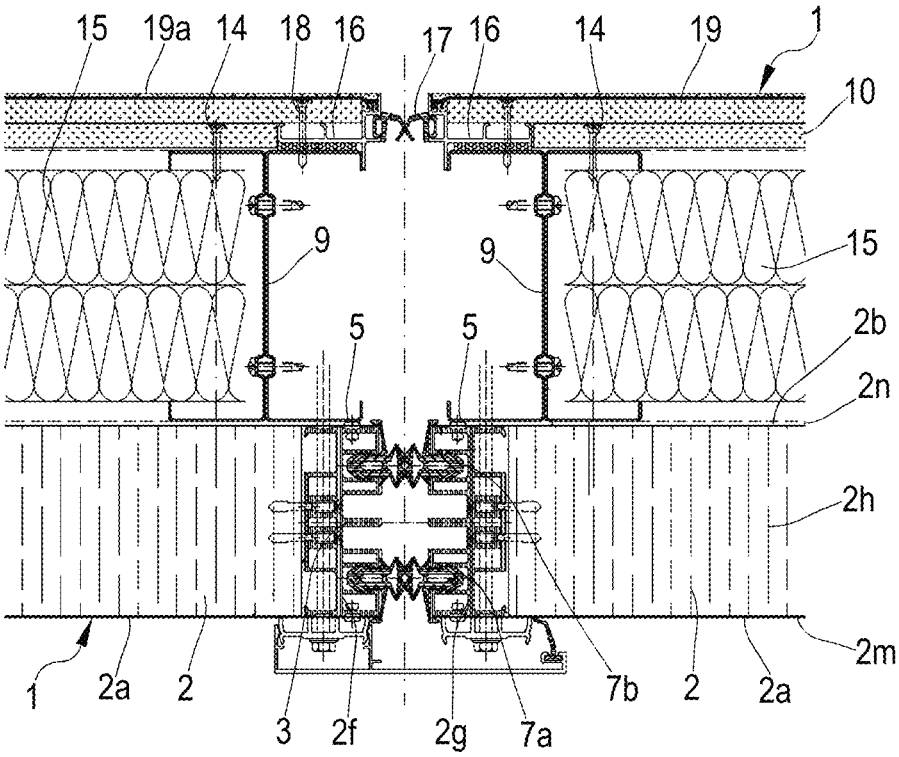
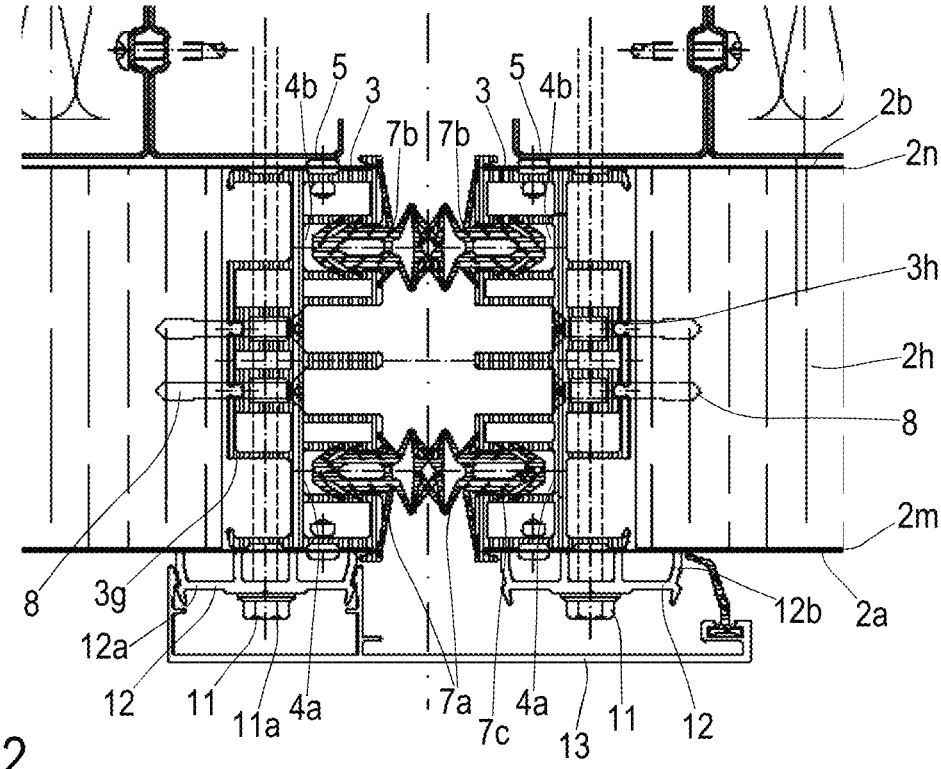
FIG.2

FIG.6
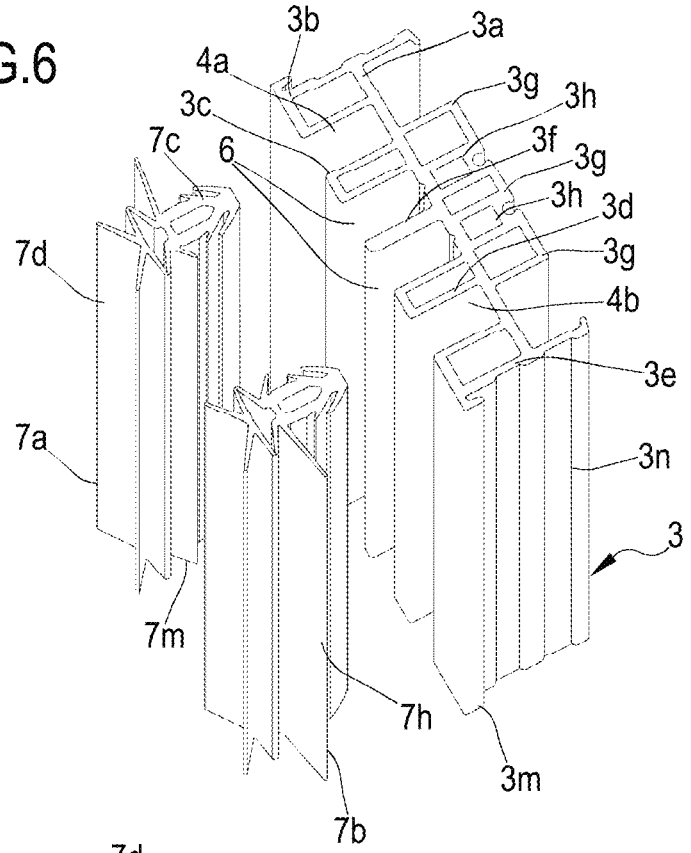
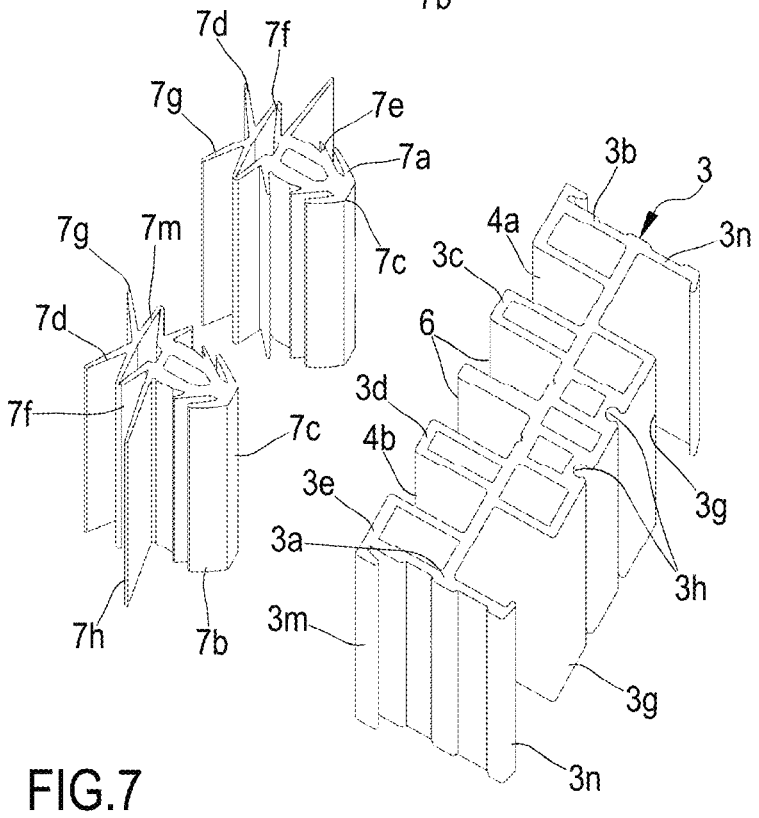
FIG.7

PREFABRICATED MODULE FOR OBTAINING A WALL FOR CLADDING BUILDINGS

TECHNICAL FIELD OF THE INVENTION

The present invention relates to a prefabricated module for obtaining a wall for cladding buildings as well as such a wall.

More specifically, the present invention relates to a prefabricated module for obtaining a so-called curtain wall.

STATE OF THE PRIOR ART

The expression "curtain wall" defines the systems for obtaining the light non-load-bearing building envelope consisting mainly of panels (transparent or opaque) connected to a metal frame that transfers the loads to the structural elements of the building.

The curtain wall provides all the performance of a traditional envelope and can be made with a transparent or opaque surface.

The European standard UNI EN 13830 Curtain walls—Product standard (EN 13830, 2015) provides a technical definition of a curtain wall as part of the building envelope made with a structure usually consisting of horizontal and vertical profiles, connected together and anchored to the structure of support of the building and containing fixed and/or opening infills, which provides all the required functions of an internal or external wall or part of them, but does not contribute to the load-bearing capacity or stability of the building structure.

The solutions currently proposed, although they guarantee a good operation, are unlikely to satisfy the requirements of the aforementioned standard.

SUMMARY OF THE INVENTION

One object of the present invention is to provide a new prefabricated or pre-assembled module for obtaining a wall for cladding buildings, in particular a prefabricated or pre-assembled module for obtaining a so-called curtain wall.

Another object of the present invention is to provide a module as indicated above which is capable of satisfying the requirements of the UNI EN 13830 standard.

Another object of the present invention is to provide a prefabricated or pre-assembled module which, once installed, is capable of guaranteeing good structural stability.

Another object of the present invention is to provide a prefabricated or pre-assembled module that can withstand permanent (own weight of the components) and accidental loads (wind, earthquake, shocks, etc.) applied to the respective facade and transmit the same to the load-bearing structure of the building.

Another object of the present invention is to provide a prefabricated or preassembled module capable of accommodating the deformations of the load-bearing structure of a building, as well as the deformations and thermal expansions of the constituent elements.

Another object of the present invention is to provide a prefabricated or pre-assembled module that is able to guarantee water and air tightness, ensure thermal insulation and sound insulation, resist fire and seismic actions as well as allow easy maintenance.

Another object of the present invention is to provide a new curtain wall or facade obtained by assembling modules as indicated above and suitable for achieving the purposes indicated above.

In accordance with one aspect of the invention, a prefabricated module is provided according to the present application.

The present application refers to preferred and advantageous embodiments of the invention.

BRIEF DESCRIPTION OF THE DRAWINGS

Other features and advantages of the invention will be more evident from the description of an embodiment of a prefabricated module and curtain wall, illustrated as an indication in the accompanying drawings in which:

FIG. 1 shows a detail in horizontal section of two prefabricated modules side by side or put near each other according to the present invention, FIG. 2 is a view of a detail on an enlarged scale of FIG. 1, FIGS. 3 and 4 are axonometric views from respective sides which illustrate an exploded view of a front or external part of a prefabricated module according to the present invention.

In the accompanying drawings, identical parts or components are indicated by the same reference numbers.

DETAILED DESCRIPTION

Figure 3:
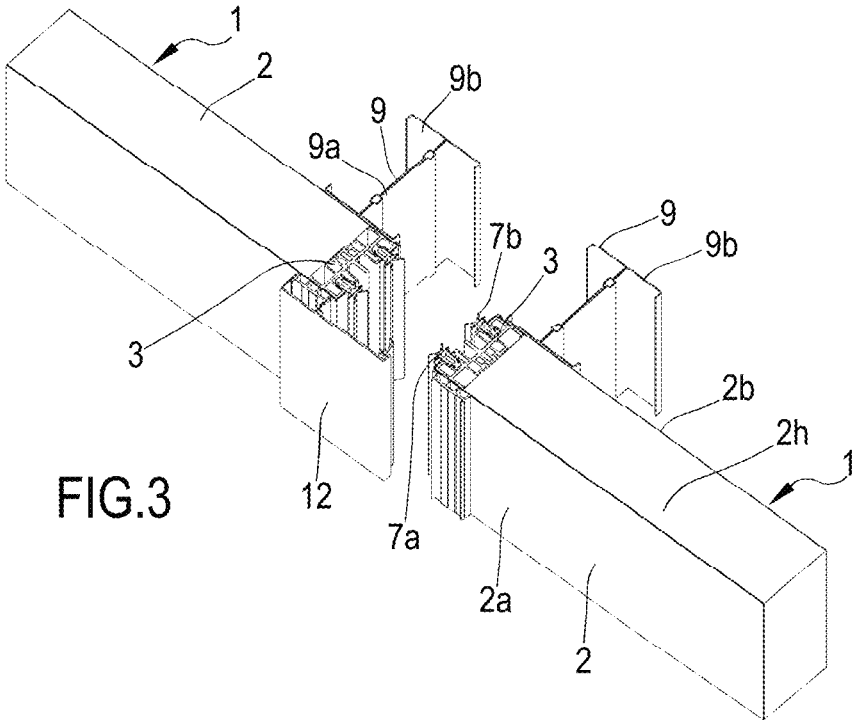
Figure 4:
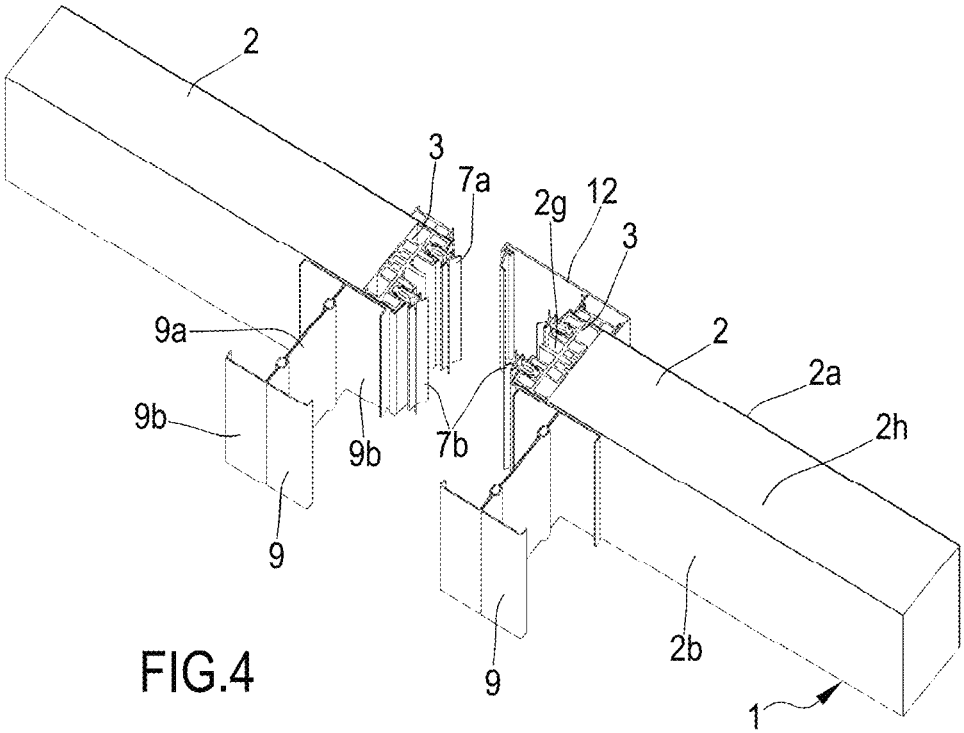
Figure 5:
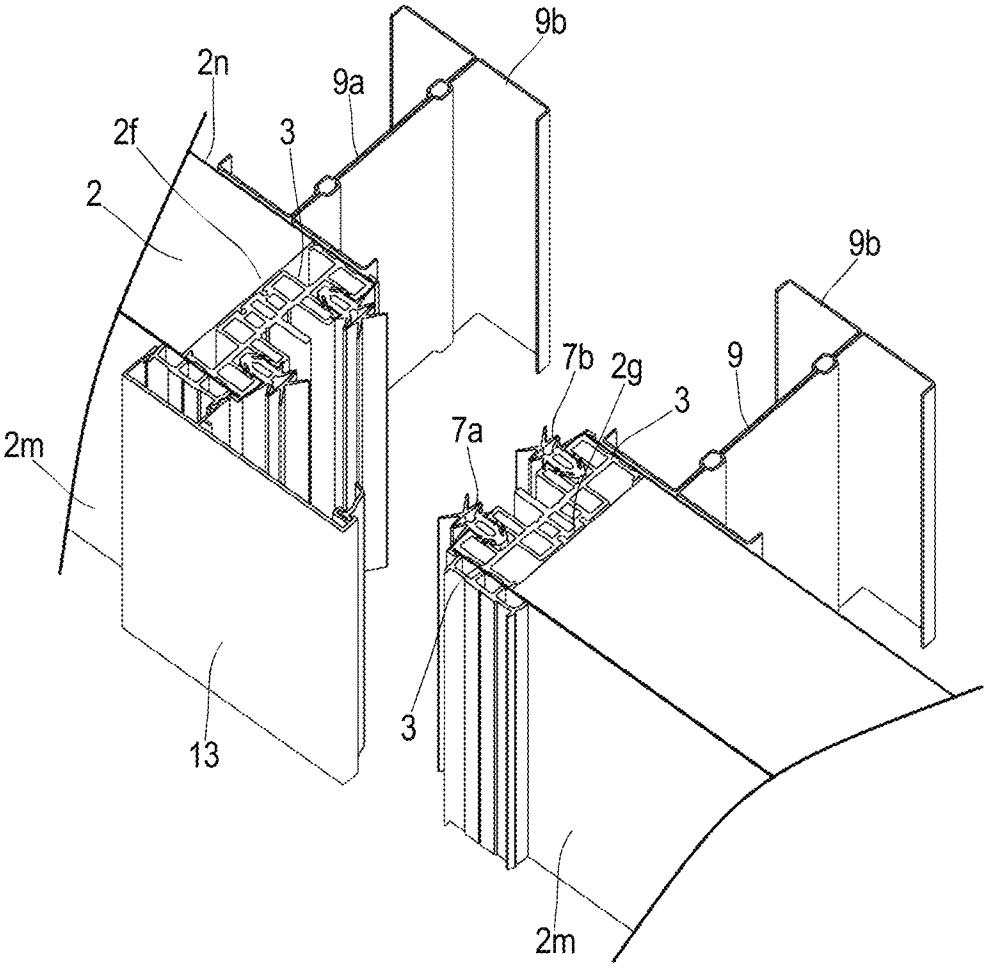
FIG. 5 is a detail on an enlarged scale of FIG. 3, FIGS. 6 and 7 are axonometric views from respective sides which illustrate in detail an edge profile and two gaskets of a module according to the present invention.
Figure 8:
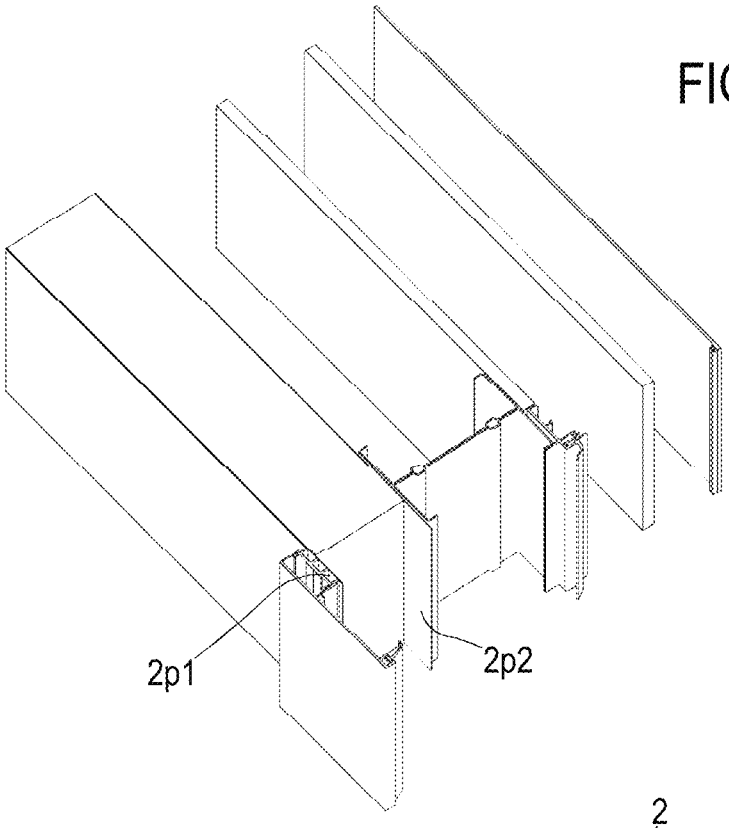
FIGS. 8 and 9 are axonometric views from respective sides which illustrate an exploded view of the components of a prefabricated module according to the present invention.
Figure 9:
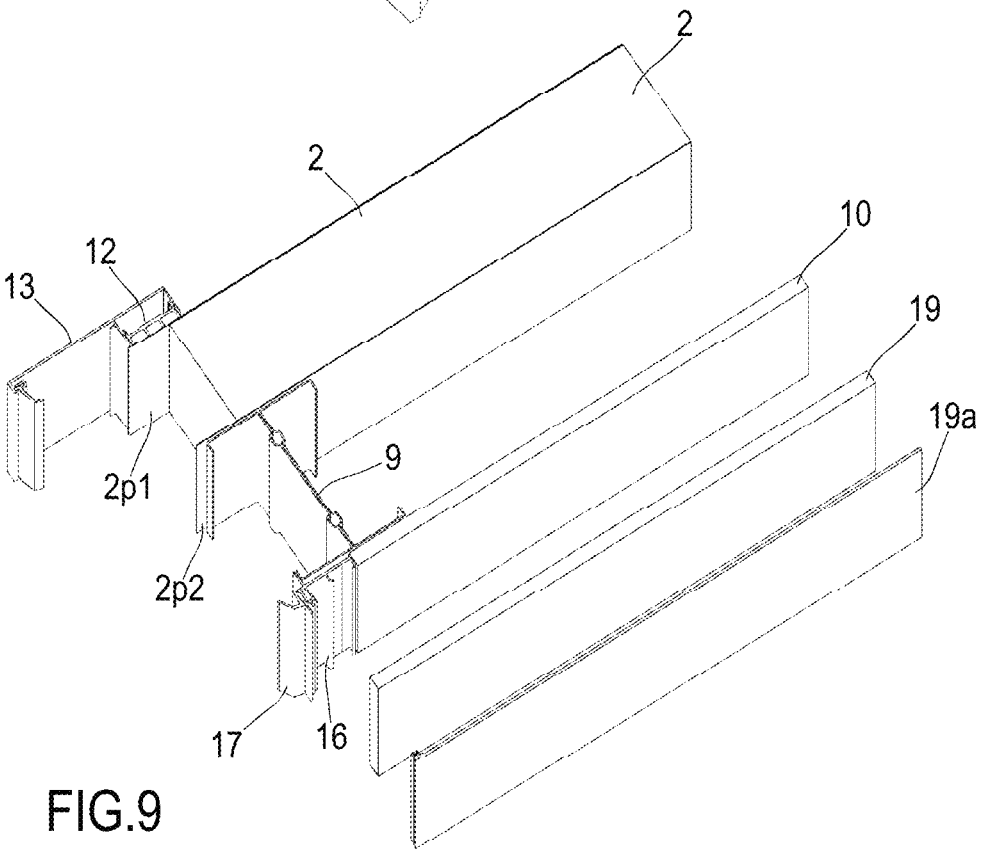

With reference to the attached figures, a prefabricated or pre-assembled module 1 is shown for obtaining an external wall for cladding buildings or external dry wall or for obtaining a curtain wall.

More particularly, a prefabricated or pre-assembled module 1 according to the present invention is used to cover or form vertical walls of buildings or even inclined walls, preferably slightly with respect to the vertical, but not horizontal walls. Naturally, as will be discussed later, in order to cover or build a wall, several prefabricated modules 1 will preferably be installed side by side with the other modules and/or under and/or above other modules 1 or even with respect to other types of modules.

Therefore, it is possible to identify an "internal" and an "external" in the prefabricated module, where the internal is the face or part that is, in use, mounted facing or against the wall to be covered or which will constitute the interior of the module or of the respective external wall, while the external is the face or part that is, in use, mounted facing away from the wall to be clad or that will constitute the external of the wall, and that therefore, once the module 1 or better the modules 1 to the wall or other walls or slabs of a building, define the new face or portion of the external face of the building, where before the installation of the unit the external face was constituted by the wall itself or was not present yet.

This premise must be taken into account in the interpretation of the internal and external terms used in this description.

With regard to the expression "prefabricated" or "pre-assembled", in this description it is meant that the module is assembled or assemblable, clearly entirely or in all its components, before it is mounted or anchored or constrained to the wall or to other walls or slabs of a building and even before being constrained or fixed to other modules to obtain a curtain wall or facade.

Basically, a module according to the present invention can be moved and mountable on site or during installation as a single piece or a single component.

Therefore, all the elements of the module or of each module are assembled or constrained together beforehand, for example in the same production plant and the module or modules is/are then brought to the place of installation or assembly or in any case approached to the wall to be covered or to other walls or slabs of a building, already assembled and thus it/them is/are constrained or fixed to the wall or to other walls or slabs of a building, moving it or moving each one as if it were a single piece or a unique component.

The module 1 first of all comprises at least one sandwich panel 2 defining two main faces 2*a*, 2*b*, an upper, in use, edge 2*c*, a lower, in use, edge 2*d* as well as two lateral edges 2*f*, 2*g*.

Advantageously, at least one sandwich panel 2 comprises a first main supporting or insulating block 2*h*, if desired made of mineral wool, expanded polyurethane or rigid foam in general or of glass wool, as well as at least one first sheet 2*m* applied or adhered to at least one external, in use, face of the first main supporting block 2*h*. If desired, at least one second sheet 2*n* applied or adhered to the other internal, in use, face of the first block 2*h* is also provided.

Moreover, the first block 2*h* could include a single layer or even comprise coupled sub-layers, each made of a respective material.

The configuration of the first block 2*h* is preferably a parallelepiped, for example a cuboid or rectangular parallelepiped, that is to say a parallelepiped whose faces are all rectangles. Preferably, the faces of the first block 2*h* are flat, but not necessarily.

The first block 2*h* can have any suitable thickness, for example a constant thickness, if desired between 50 mm and 200 mm.

The sheet or sheets 2*n*, 2*m* can have any suitable thickness, for example a constant thickness, if desired between 0.3 and 1.2 mm or between 0.4 and 1 mm.

Preferably, the first 2*m* and the second 2*n* sheet can protrude for a protruding section 2*p*1, 2*p*2, for a reason which will be discussed later, laterally with respect to the first block 2*h*, for example of an entity between 20 and 50 mm.

In this regard, considering the cuboid or rectangular parallelepiped configuration of the first block 2*h*, the first 2*m* and the second 2*n* sheet can protrude with respect to some or all sides of the first block 2*h*, thus with respect to the upper, lower and/or to one or both sides of the first block 2*h*.

With regard to this aspect, if this arrangement is envisaged, the two sheets 2*m* and 2*n* protrude with respect to the same or the same sides of the first block 2*h*, preferably of the same size and preferably for the entire extension of the respective side of the first block 2*h*.

In this regard, an edge zone of the panel 2 which is hollow remains defined between the sheets 2*m* and 2*n* and this can be provided at the upper, in use, edge 2*c* and/or the lower, in use, edge 2*d* and/or of one or both of the two lateral edges 2*f*, 2*g*.

If the first block 2*h* is made of expanded polyurethane or other expandable component, then the bond between the first block 2*h* and the sheet (s) 2*m*, 2*n* could be obtained by adhesion following the expansion of the polyurethane or expandable component close to the sheet(s) 2*m*, 2*n* before the final hardening or solidification of the polyurethane or expandable component.

If the first block 2*h* is made of a non-expandable component, such as for example wool, if desired mineral or glass wool, this is preferably constrained to the sheet 2*n*, 2*m*, if desired by means of glue.

The sheet 2*m* could be a smooth sheet or with more or less wide ribs.

Then at least one edge profile, if desired two and preferably at least four edge profiles 3 is/are provided, each mounted on a respective edge 2*c*-2*g* of the panel. If four profiles 3 are provided, they effectively define a perimeter frame of a sandwich panel 2, whereby each vertical profile 3, in use, is preferably in contact at respective ends with the horizontal, in use, sections.

The profile or each profile 3 defines at least one main seat 4*a*, 4*b* extending for the entire extension or length of the edge profile 3, i.e. the extension, in use, from the top to the bottom of the module 1.

Advantageously, one or more of the profiles 3 is grafted or inserted, preferably to size, between the protruding sections 2*p*1, 2*p*2 of the sheets 2*m*-2*n*, if this arrangement is envisaged.

Preferably, the prefabricated module 1 includes screws, bolts and/or rivets 5 for fixing one or more of the edge profiles 3 to the sandwich panel 2. Such screws, bolts and/or rivets 5 could be fitted in the protruding portions 2*p*1, 2*p*2, if provided, of the sheets 2*m*, 2*n* and in the profiles 3.

With reference now to the configuration of the profiles 3 according to the non-limiting embodiment illustrated in the figures, one or more of the same can have a base plate or diaphragm 3*a*, for example but not necessarily flat, and one or more projecting components if desired, tubular, designed to define the main seats 4*a*, 4*b* as well as any other auxiliary seats 6.

One or more of the main seats 4*a*, 4*b* and the auxiliary seat(s) 6 are preferably open only on the same side of the respective profile 3, i.e. they are open only in the direction away from the respective edge of the relevant panel on which this profile 3 is mounted and they are blind or closed on the opposite side. In substance, at least one or preferably all the main seats 4*a*, 4*b* and the auxiliary seat or seats 6 are preferably not through.

More specifically, the base plate 3*a* is designed to be installed in use parallel to a respective edge 2*c*-2*g* of the panel 2 or of the first block 2*h*, while the projecting components extend from the base plate 3 away from and/or into approach to the respective first block 2*h* of the panel.

Preferably, if the sheets 2*m*, 2*n* have at least one protruding section 2*p*1, 2*p*2 for housing a profile 3, then any base plate 3*a* would have an extension in the outer-inner direction substantially corresponding to the or a respective protruding section 2*p*1, 2*p*2.

With reference to this aspect, on the side of the base plate 3 distal, in use, from the first block 2*h*, or facing away from it, at least two projecting components are provided, if desired tubular ones defining a main seat 4*a*, 4*b* between them.

In this regard, at least three projecting components are provided defining between them (two by two) two main seats 4*a*, 4*b*.

More particularly, according to the non-limiting embodiment illustrated in the figures, from the outside to the inside, it is provided a front or external projecting component 3*b*, for example tubular, a first intermediate projecting component 3*c*, for example tubular, delimiting a first main seat 4*a* with the front or external projecting component 3*b*, if desired a second intermediate projecting component 3*d*, for example tubular, at a distance from the first intermediate projecting component 3*c* so as to define with it at least one auxiliary seat 6, and a rear or internal projecting component 3*e*, for example tubular, delimiting a second main seat 4*b* with the first intermediate projecting component 3*c* or, if provided, with the second intermediate projecting component 3*d*.

Preferably, the extension in the external-internal direction of the front or external projecting component 3*b* and of the rear or internal projecting component 3*e* is different, for example more or less, for example in a ratio between 3/2 and 3, of the extension in the external-internal direction of the intermediate projecting component (s) 3*c*, 3*d*.

If desired, a central projecting component 3*f* is also provided between the two intermediate projecting components 3*c*, 3*d* for separating the auxiliary seat 6 into two smaller auxiliary seats 6.

Some and preferably all of the components 3*b*, 3*c*, 3*d*, 3*e*, 3*f* extend for the entire length of the respective edge of the respective panel 2, so that the main seats 4*a*, 4*b* and any auxiliary seats 6 extend for the entire length or extension or perimeter of the respective profile 3.

Advantageously, the projecting components 3*b*-3*f* have the same height or the same distance between the respective free end and the base plate 3*a*.

Projecting components, for example tubular, can also be provided starting from the side of the base plate 3*a* proximal, in use, to the first block 2*h* or facing it.

Thus, for example, two or three projecting components greater than 3*g* or of greater height (distance from the base plate 3) alternating with one or two smaller projecting components 3*h* or of lesser height can be provided.

If desired, the minor projecting component (s) 3*h* are aligned with a respective auxiliary seat 6.

Some and preferably all components 3*g*, 3*h* extend for the entire length of the respective edge 2*c*, 2*g* of the respective panel 2.

At the external and/or internal end or side of the profile 3, connection/finishing fins 3*m* can be provided, for example U-shaped, for fastening to a respective part of a panel 2, for example to a free end of a respective sheet 2*m*, 2*n* or of respective protruding section 2*p*1, 2*p*2 thereof.

If desired, these connecting/finishing fins 3*m* extend from the edges of a front or external projecting component 3*b* (if provided) or of a rear or internal projecting component 3*e* (if provided) distal from the respective main block 2*h*.

The profile 3 can then have wing components 3*n* each extending from the sides of the base plate 3*a* approaching the main block 2*h* of the respective panel 2. These wing components 3*n* define the external or internal end of a profile 3, if desired together with a section of the external or internal wall of a respective projecting component 3*b*, 3*e*.

If desired, the height or width of a profile 3, i.e. the distance of the free end of the block components 3*b*-3*f* rising from one side of the base plate 3*a* and the free end of the block components 3*g*, 3*h* rising on the other side of the base plate 3*a*, is substantially equal to or slightly less than the extension of respective protruding sections 2*p*1, 2*p*2 of the sheets 2*m*-2*n*, so that the profile 3 can, in use, be entirely housed in the space defined by the protruding sections 2*p*1, 2*p*2 of an external sheet 2*m* and of an internal sheet 2*n* at a respective edge section.

A profile 3 can be made of any suitable material, such as for example PVC, aluminum or polyamide or a material obtained through a pultrusion process.

One, some or each profile 3 is preferably made in a single piece or alternatively in two or more pieces connected, for example mechanically, if desired by means of interlocking.

The module is then provided with at least one gasket, or two or three or at least two, three or four gaskets 7*a*, 7*b*, it or each mounted within a respective seat 4*a*, 4*b* of a respective edge profile 3 and extending therefrom for the engagement of an adjacent module 1. Preferably, gaskets 7*a*, 7*b* are provided which are mounted at least in the lower, in use, edge 2*d* as well as in the two lateral edges 2*f*, 2*g*.

This or these gaskets 7*a*, 7*b* have a length substantially equal to the length of a respective edge 2*c*-2*g* of the sandwich panel 2, that is to say of the edge 2*c*-2*g* on which they are mounted or better on which a respective profile 3 is mounted.

If advantageously at least one of the edge profiles 3 defines at least two auxiliary seats 4*a*, 4*b* in correspondence with at least one respective lateral edge 2*c*-2*g*, at least two gaskets 7*a*-7*b* are preferably provided for one or each profile 3 and in the two seats 4*a*, 4*b* on at least one lateral edge 2*c*-2*g* of the sandwich panel 2 two gaskets are mounted, one 7*a* in the innermost, in use, position and the other 7*b* in the outermost, in use position.

If three or six gaskets 7*a*, 7*b* are provided, they actually define one (7*a* or 7*b*) or two (7*a* and 7*b*) sections of the frame with three sides of respective profiles 3, so that each lower horizontal, in use, gasket 7*a* is preferably in contact at respective ends with the vertical, in use, gaskets.

With reference to the specific non-limiting configuration of the gasket/s 7*a*, 7*b*, it or each of them has a tip 7*c* designed to be inserted or fitted, for example to size in a respective main seat 4*a*, 4*b* and a tail 7*d* protruding for the engagement with respective sections or gaskets of adjacent modules and designed to abut with respective projecting components 3*b*-3*f* extending from the side of the base plate 3*a* distal from the main block 2*h* of the respective panel 2.

The tip 7*c* can be tapered in whole or in part away from the tail 7*d* and can also have the first dovetail portions 7*e*, that is, a series of staggered wall sections in the direction of approaching the tip 7*c*.

The tail 7*d* can instead comprise second dovetail portions, for example, moving away from the tip 7*c* with a first enlarged portion 7*f*, if desired tubular (for example with a triangular section), and then a section, if desired V- or U-shaped 7*g* with increasing section away from the tip 7*c*.

Moreover, wings 7*h*, 7*m* extending, one towards the outside and the other towards the inside, can be provided, starting from a zone between the rear 7*d* and the tip 7*c* away from the main body of the tail 7*d*.

Advantageously, the wings 7*h*, 7*m* are slightly inclined towards the tip 7*c* or towards a respective edge 2*c*-2*g* of a respective panel 2, that is to say that the respective free end is closer to a respective edge 2*c*-2*g* of a respective panel 2.

Even more advantageously, the wings 7*h*, 7*m* have a different extension in external-internal direction, a greater 7*h*, in the order between 3/2 and 2 or 3 or 4 or 5 compared to the other 7*m*. Alternatively, the wings 7*h*, 7*m* have the same extension.

In use, the tip 7*c* of each gasket 7*a*, 7*b* is fitted or inserted to size in a respective main seat 4*a*, 4*b*, while the wings 7*h*, 7*m*, if provided, abut, if desired with slight bending against a respective projecting component 3*b*-3*e*.

Thus, for example, the major wing 7*h* can rest against the front or external projecting component 3*b* or against the rear or internal projecting component 3*e*, while the smaller wing 7*m* can rest against the first 3*c* or second 3*d* projecting intermediate component, although it could also be the vice-versa.

The rear 7*d* of the gasket, on the other hand, protrudes with respect to the profile 3, thus constituting a portion of support and sealing against a gasket of an adjacent module 1 or fitted into a profiled 3 fixed to an adjacent panel 2.

Some and preferably all the components of a gasket 7*a*, 7*b* extend for the entire length of the respective edge 2*c*, 2*g* of the respective panel 2 or of the respective profile 3, so that the gasket (s) 7*a*, 7*b* extend over the entire length or extension of the respective profile 3 or better of the respective main seat 4*a*, 4*b*.

The gaskets 7*a*, 7*b* are made of any suitable material, such as EPDM or silicone.

One, some or each gasket 7*a*, 7*b* is preferably made in one piece.

If desired, additional fastening means can be provided, such as screws 8 fitted starting from any auxiliary seats 6, in projecting components 3*g* or 3*h* and therefore in the edge of a panel 2 to obtain a more firm connection of a profile 3 to a respective panel 2 More specifically, the screws 8 could be inserted so as to pass through the base plate 3*a* until they reach and engage at their head, on the bottom (or end proximal to the panel 2) of a respective minor projecting component 3*h*. Alternatively, angular components could be used, for example made of nylon, which are inserted into the projecting components 3*g*.

Moreover, the profile 3 in one of the edges, in particular in the upper edge 2*c* of the panel 2 of a prefabricated module 1 is left without a gasket, which will then be assembled on site, as will be explained better later.

According to the non-limiting embodiment illustrated in the figures, the module 1 has, in a direction from the outside towards the inside starting from the unit, comprising a sandwich panel 2 and one or more profiles 3 mounted on one, some or all of the edges of the same, at least one main frame 9 fixed to said unit 2, 3 by means of screws, bolts and/or rivets and, if desired, at least one sheet 10, fixed to the main frame 9.

If desired, two, three or more main frames 9 are provided for each module, each mounted at a respective edge and/or an intermediate portion of a panel 2.

As regards the fastening of the or of a frame 9 to a panel 2 in more detail, at least one connection screw 11 passing through at least one panel 2 starting from the outside to the inside of the same and through the main frame 9 can be provided, so as to fix the panel 2 to the main frame 9. For each panel 2, for example, two, three or more screws 11 can be provided, mounted at respective edge sections of the panel 2.

With reference to this aspect, the screw or each screw 11 can pass through one or more of the projecting components 3*g*, 3*h* extending from the side of the base plate 3*a* proximal, in use, to the first block 2*h* or facing it as well as through the sheet(s) 2*m*, 2*n*, if desired through respective protruding sections 2*p*1, 2*p*2. In this case, the connecting screw 11 may not pass through the first block 2*h*.

If desired, at least one external auxiliary profile 12 is also provided, mounted between the head 11*a* of a connecting screw 11 and the external, in use, face of a respective sandwich panel 2 or better of a respective sheet 2*m*.

This external auxiliary profile 12 can have a main plate 12*a* with a series of protuberances 12*b*, if desired as a section of the wall extending therefrom, in use, towards the panel 2, so as to define the thickness of the profile 12 and thus space the head 11*a* of the connection screw 11 and the external, in use, face, of a respective sandwich panel 2 or better of a respective sheet 2*m*.

The external auxiliary profile 12, if provided, can be made of any suitable material, for example metal, such as aluminum or other material.

The module 1 or rather a group consisting of respective pairs of side-by-side modules 1 can be provided with a joint cover profile 13, made of any suitable material, for example metal, such as aluminum or other material, which joint cover profile 13 is designed to conceal, in use, the joint between two adjacent panels and thus the respective profiles 3.

More specifically, a joint cover section 13 can be provided so as to be constrained on one side to an external auxiliary section 12 mounted on a first panel 2 of a first module and on the other to an external auxiliary section 12 mounted on a second panel of a second module adjacent to the first.

With specific reference to the main frame 9, it can be made of any suitable material, such as steel.

This component 9 can have an appropriate configuration, for example C-shaped or double C, thus with an intermediate portion 9*a*, for example flat sheet-like and two end portions 9*b*, each perpendicular to the intermediate portion 9*a* and extending from a respective end thereof.

One, two, three or four C-shaped or double C frames can be provided for a module 1. If in particular four frames 9 are provided, they effectively define a perimeter frame, so that each, vertical, in use, frame or section of frame 9 is preferably in contact and constrained at respective ends with the horizontal, in use, frames or sections of frame 9. In this regard, adjacent frame sections 9 can be connected in any suitable way, for example by means of intermediate square or plate components, for example L-shaped 9*c*.

With regard to the at least one plate 10, if provided, it can include one, two or more plates, if desired made of calcium silicate, plasterboard, fiber cement, fiber gypsum, fiber reinforced cement, OSB, wood or composite materials or other suitable material, designed to finish internally the wall.

If desired, a first end portion 9*b* of the main frame 9 rests against a portion of a panel 2 or a respective sheet 2*n* and a second end portion 9*b* of the main frame 9 rests against a portion of a sheet 10.

Fastening means 14, such as screws, rivets or bolts are then clearly provided between the main frame 9 and the plate 10.

The module 1 can then also include filling means 15, such as for example wool, between the plate 10 and the sandwich panel, which filling means are alongside or between main frames 9.

Preferably, a wall or facade according to the present invention comprises two, three or a plurality of prefabricated modules 1 as indicated above which are placed side by side or put near each other or placed one above and one below the other.

In this case, a gasket 7*a*, 7*b* mounted within a seat 4*a*, 4*b* of a profile 3 mounted on a first sandwich panel 2 of a first module is in sealing engagement for its entire length with a gasket 7*a*, 7*b* mounted within a seat 4*a*, 4*b* of a profile 3 mounted on a second sandwich panel 2 of a second module adjacent to the first.

More particularly, according to the non-limiting embodiment shown in the figures, the tail 7*d* of an external gasket 7*a* of a first module 1 is in sealing engagement with the tail 7*d* of an external gasket 7*a* of a second module and the tail 7*d* of an internal gasket 7*b* of a first module 1 is in sealing engagement with the tail 7*d* of an internal gasket 7*b* of a second module 1.

In this regard, two gaskets 7*a*, 7*b* of two adjacent modules in sealing engagement are in contact and, in fact, pushed against each other, for their entire extension, therefore for the entire length of the respective side, bottom, top or side of the respective module. These gaskets absorb movements and maintain sealing performance.

Figure 10:
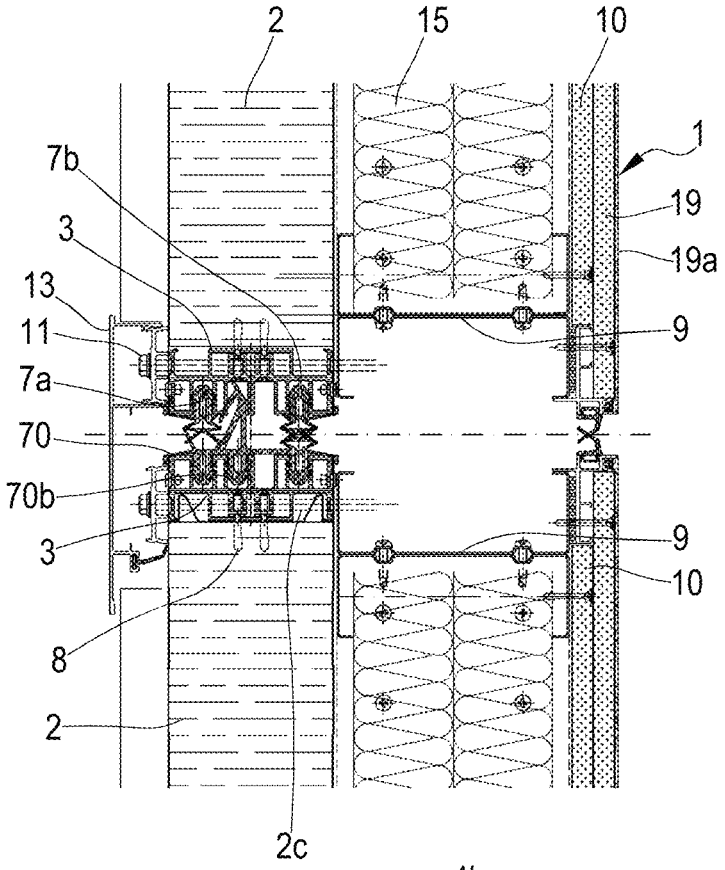
FIG. 10 shows a detail in vertical section of two prefabricated modules placed side by side or put near each other according to the present invention.
Figure 11:
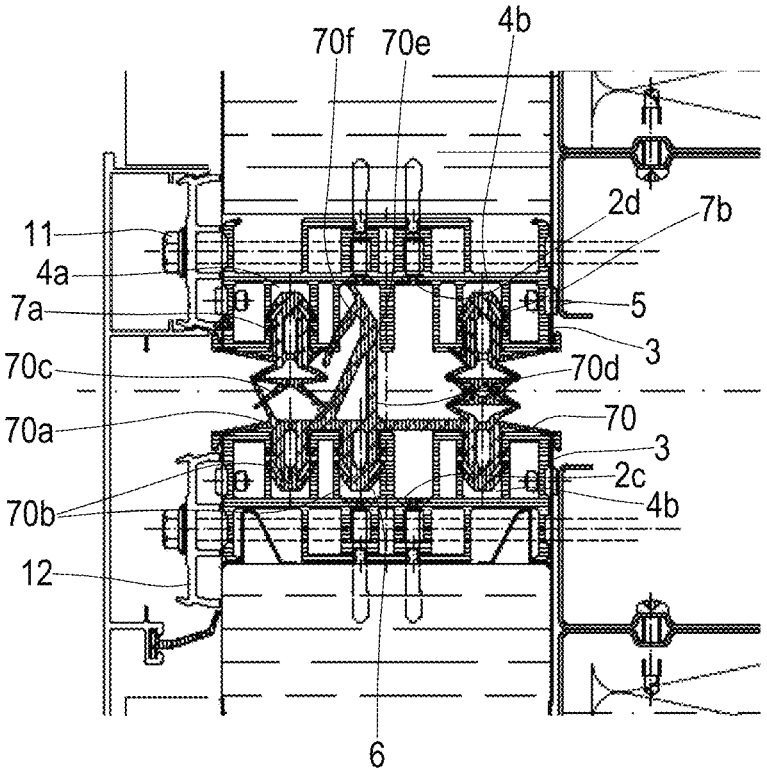
FIG. 11 is a view of a detail on an enlarged scale of FIG. 10.
Figure 12:
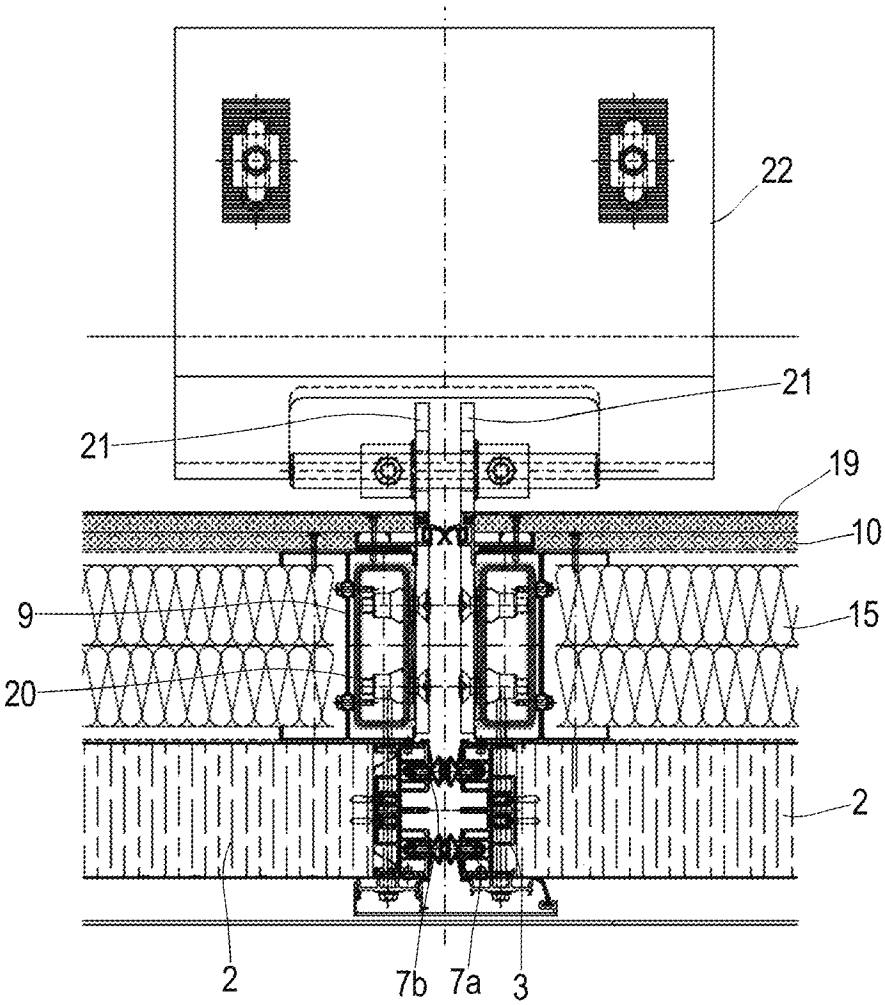
FIG. 12 shows a detail in horizontal section of prefabricated modules of a wall according to the present invention constrained to a slab.
Figure 13:
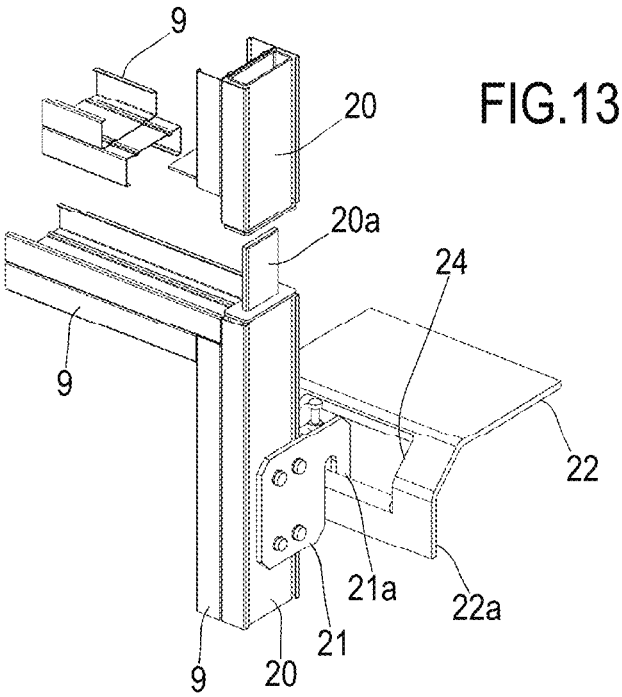
FIGS. 13 and 14 illustrate steps of constraining a module according to the present invention to a floor, FIGS. 15 to 18 schematically illustrate possible uses of a module according to the present invention or of a respective curtain wall.
Figure 14:
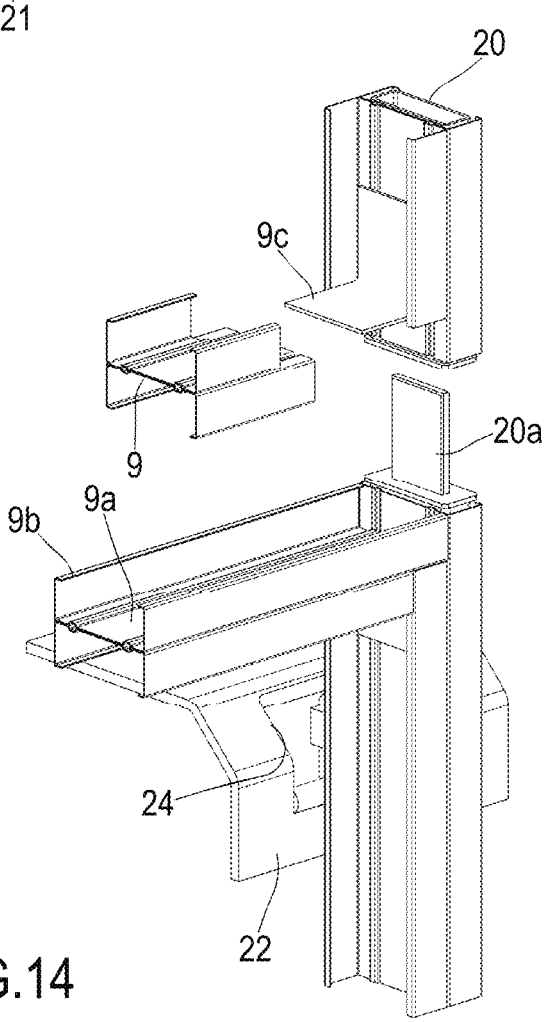
Figure 15:
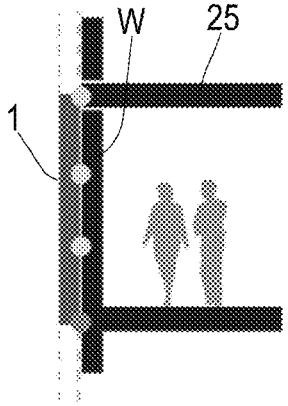

Moreover, as indicated above, the profile 3 mounted on the upper edge 2*c* of the panels 2 is kept without a gasket before the mounting or assembly of more modules, then inserting a so-called continuous gasket 70 (see FIGS. 10 and 11), which it is different from as described above, for example in profiles 3 mounted on the upper edge 2*c* of the panels or on another component of the modules, for example in accordance with solutions according to the prior art. Advantageously, a continuous gasket 70 is provided for each horizontal row of modules.

This continuous gasket 70 is defined as a tile roofing sheet and performs the task of preventing any water infiltration through the panel. It is continuous in the sense that it extends for two or more modules, preferably for a series of modules placed side by side horizontally.

In this regard, once the first row or lowest row of modules 1 has been mounted, the gasket 70 is mounted in the possible upper profiles 3 of the modules 1 and then the modules 1 of the second row or upper row are mounted, so that the tails 7*d* of the external gaskets 7*a* and/or internal 7*b* of the second row of modules 1 come into sealing engagement against the continuous gasket 70.

As regards the configuration of the continuous gasket 70, it can comprise a main plate or diaphragm 70*a* from one side of which extend one, two or more pointed portions 70*b* similar to the tips of the gaskets 7*a*, 7*b*, while on the other side one, two or more tail portions 70*c* extend similar to those of the gaskets 7*a*, 7*b*, to the description of which we refer integrally, and substantially aligned with two of the pointed portions 70*b*, similar to those of the gaskets 7*a*, 7*b*, to the description of which we refer integrally, for example to an external and an internal pointed portion 70*b*.

A protuberance 70*d* is then provided extending from the same side of the tail portions 70*c*, but of considerably greater extension, of an order from 2 to 6 times of the latter.

The protuberance 70*d* comprises, according to the embodiment illustrated in the figures, an initial section 70*e*, for example hollow with one or a pair of walls, for example inclined to each other, and then a free end 70*f*, for example L-shaped with open concavity moving away from the initial section 70*e*.

The gasket 70 can be mounted so as to have the respective tips 70*b* mounted two in two respective main seats 4*a*, 4*b* and one in an auxiliary seat 6 of a profile 3 of a lower module 1, while the protuberance 70*d* has the respective free end 70*f* mounted within an auxiliary seat 6 of an upper module 1. As regards the tail portions 70*c*, for example, they can be in sealing engagement one with the tail 7*d* of an external gasket 7*a* and the other with the tail 7*d* of an internal gasket 7*b* of an upper module.

As regards the interior of a wall or facade obtained by means of modules 1 placed side by side or put near each other, for example as a mosaic, a respective internal profile 16 is mounted, on site or on the building site, in correspondence with the at least one plate 10 of one or each module, preferably, which profile is suitably shaped so as to house one end of an internal gasket 17 which helps to make the facade fireproof.

This internal profile 16 can be fastened to the frame 9 or to a respective terminal portion 9*b* by means of suitable fastening means, such as screws, bolts or rivets 18.

In this case, advantageously two adjacent modules each comprise a respective internal profile 16 so that these profiles support, each on a respective side, an internal gasket 17.

A second plate 19 can also be provided, if desired made of calcium silicate, plasterboard, fiber cement, gypsum fiber, fiber reinforced cement, OSB, wood or composite materials or other suitable material mounted internally to one or each first plate 10 and designed to internally line the first plate 10 and the internal profile 16.

Moreover, this second plate 19 can be internally lined with a suitable covering component 19*a*, made of a suitable material, if desired internally plastered.

With reference then to the constraint of modules 1 assembled to a building, this can be achieved by means of constraint profiles 20, for example tubular ones mounted on the main frame 9.

A bracket 21 is then provided which is mounted, for example by means of screws, bolts and rivets to the constraint profiles 20 and terminating with a connection section 21*a*, for example with a hook or grapple for attachment to a mounting plate 22 integral, for example by means of screws, bolts or similar components to the slab 25 of a building.

The mounting plate 22 could instead delimit a through opening 24, the hook or grapple connection section 21*a* being mountable on the mounting plate 22, for example with a free end mounted or hooked into the through opening 24 astride a section, if desired vertical or inclined with respect to the vertical 22*a*, of the mounting plate 22.

The engagement between bracket 21 and plate 22 allows transverse or horizontal displacements or adaptations, which ensure transverse adaptations of the respective module.

It will also be understood that adjacent or put near each other modules can have respective brackets 21 mounted in the same plate 22, so that pairs of adjacent modules have the same support component integral, for example by means of screws, bolts or components similar to the slab 25 of a building.

As regards in detail the constraint profiles 20, they could have vertical tubular sections connected by means of screws, bolts, fittings, couplings or similar solutions with the main frame 9, for example with a vertical section thereof. More specifically, for each module 1 one or two constraint profiles 20 can be provided, each connected to a respective frame 9 mounted or constrained to a lateral edge 2*f*, 2*g* of the respective panel 2, for example on a vertical section of the frame 9.

In this regard, the constraint profiles 20 serve to guide the positioning of an upper module with respect to a lower module, this can be done by aligning one or two vertical constraint profiles 20 of an upper module with one or a respective profile constraint 20 of a lower module. The constraint profile 20 of a lower module is connected to a constraint profile 20 of an upper module in any suitable way or means, for example by means of so-called swords components 20*a*.

Preferably, each module 1 has two constraint profiles 20, each connected to a vertical frame section 9, one on one side and one on another side of the module, on each constraint profile 20 a respective bracket 21 being mounted for the engagement, for example for hooking to a respective mounting plate 22 integral, for example by means of screws, bolts or components similar to the slab 25 of a building.

As can also be derived from FIGS. 15 to 18, it is clear that modules 1 according to the present invention can be mounted to cover or infill an existing wall W (FIG. 15), closing a main opening MO defined by a building with a slab 25 for obtaining an external wall with (FIG. 16 or 18) or without (FIG. 17) window 26.

Figure 16:
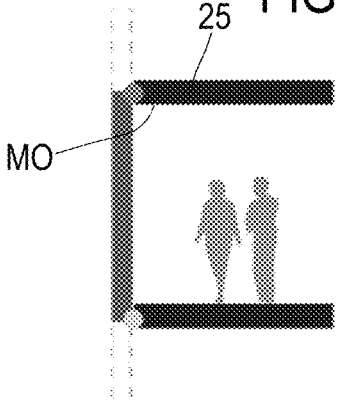
Figure 17:
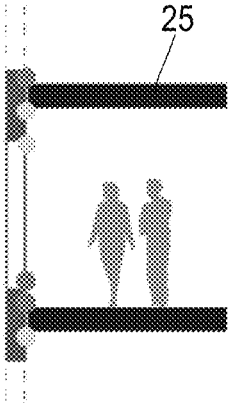
Figure 18:
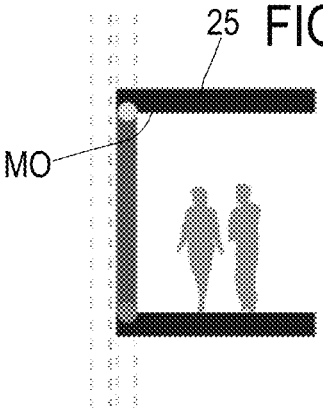
Figure 19:
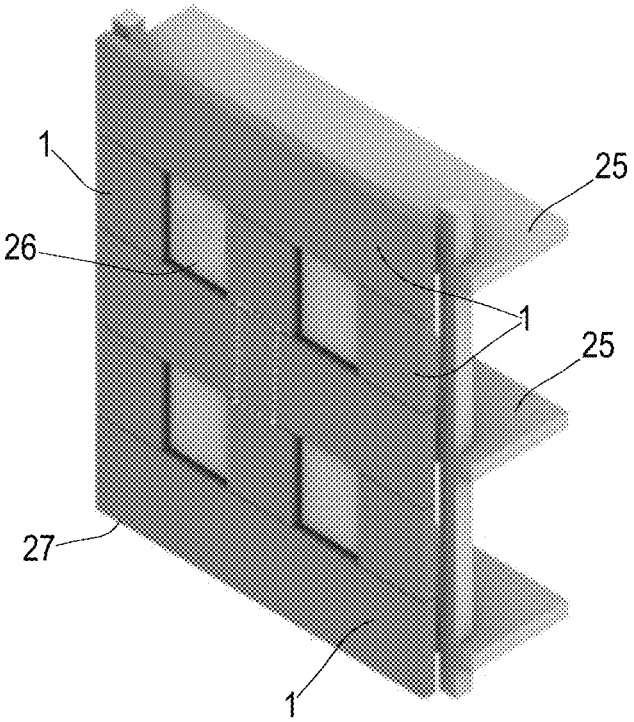
FIG. 19 illustrates an axonometry of a wall or curtain wall according to the present invention applied to the slab of a building.
Figure 20:
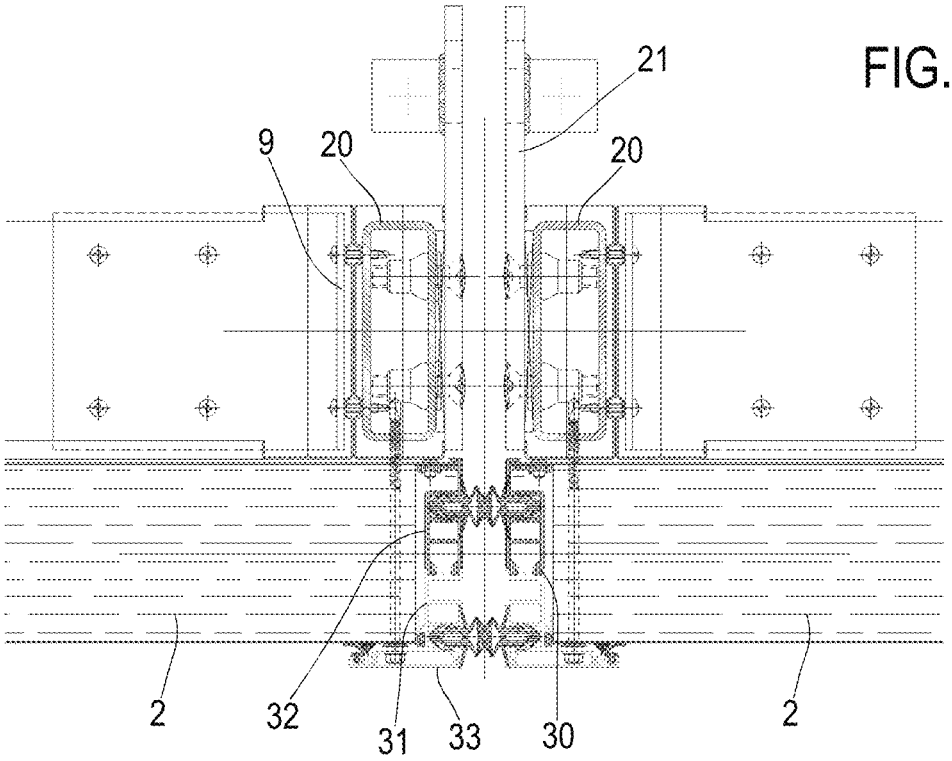
FIG. 20 shows a detail in horizontal section of two prefabricated modules placed side by side or put near each other according to another example according to the present invention.
Figure 21:
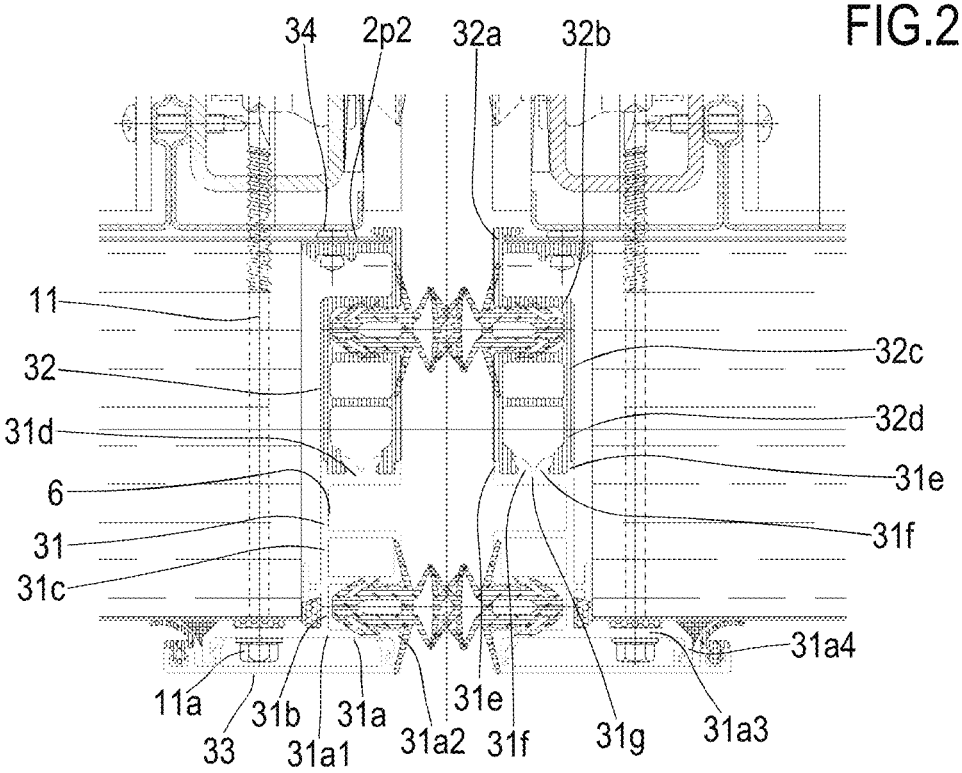
FIG. 21 is a view of a detail on an enlarged scale of FIG. 20.
Figure 22:
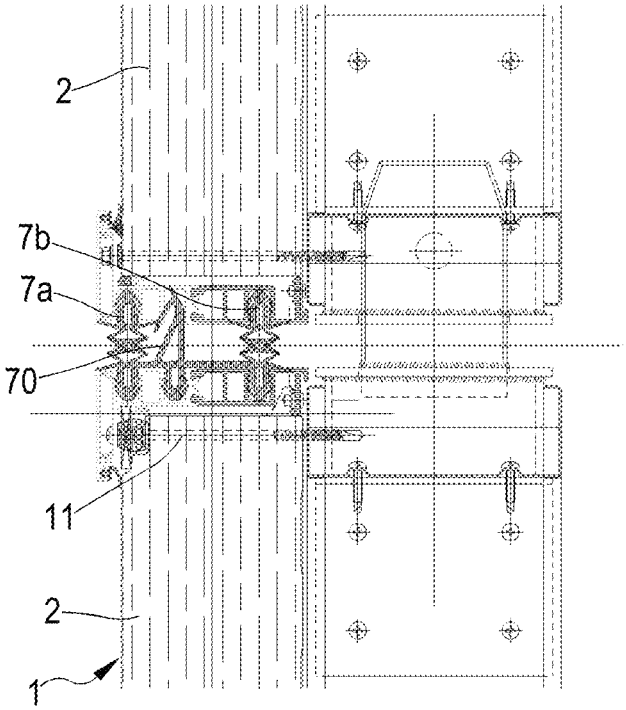
FIG. 22 shows a detail in vertical section of two prefabricated modules side by side or put near each other according to another example according to the present invention.
Figure 23:
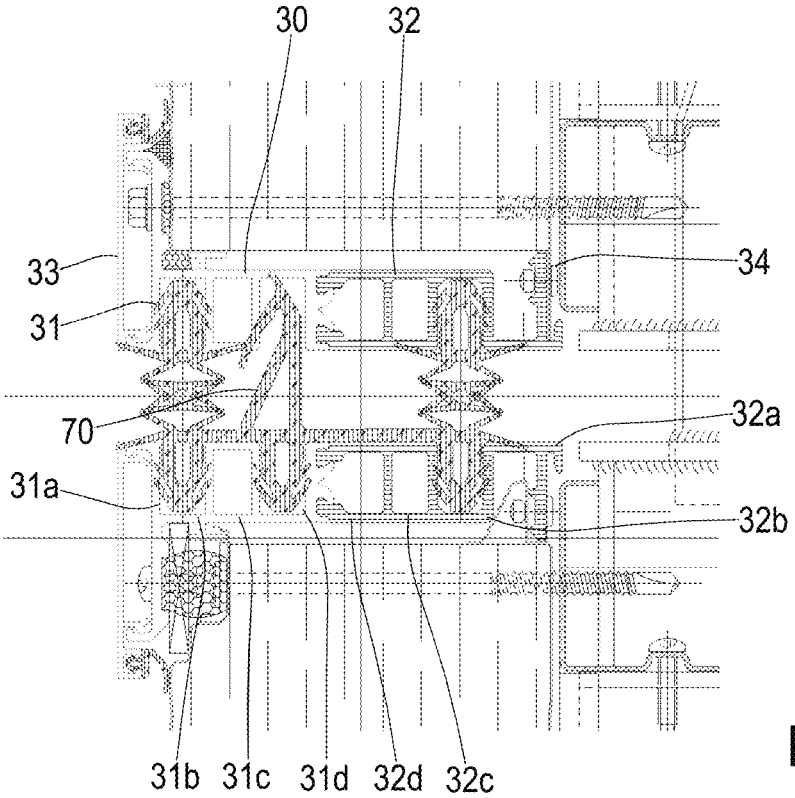
FIG. 23 is a view of a detail on an enlarged scale of FIG. 22.

Moreover, the modules can be assembled within (FIG. 18) an opening defined by other components of a building or protruding from it (FIG. 16).

The subject-matter of the present invention is also a group for covering a wall comprising at least two prefabricated modules side by side or placed one above the other and with respective gaskets in engagement.

The subject-matter of the present invention is also a building 27 comprising a series of modules linked to a component or slab of the building, for example as described above.

As it will be possible to ascertain, a method for the assembly or installation of modules according to the present invention provides to assemble or mount the modules in the production site or in the installation site, then to mount or install on a wall or on a slab the modules as indicated above, first making rows of lower modules with modules side by side having respective gaskets 7*a*, 7*b* in sealing engagement and then, after having possibly mounted one or more gaskets 70 in upper profiles 3 of the modules 1 of the lower row or rows, mount upper rows with upper modules having gaskets 7*a*, 7*b* in sealing engagement with gaskets 70 of lower modules until a desired wall is obtained.

For the assembly of the modules it is possible, for example, to hook the brackets 21 with the plates 22.

With reference now to FIGS. 20 to 23, another embodiment of modules and group in accordance with the present invention similar to the one described above is illustrated, but in which one or more profiles are provided which are not in a single piece, but they consist of two or more parts or elements connected to each other.

More specifically, at least one (preferably all) profile 30 of a respective module comprises two parts 31, 32, one external or the other internal each defining one or more respective main seats 4*a* and, if desired, one or both also defining one or more auxiliary seats 6.

These parts 31, 32 are connected together with any suitable means, such as for example screws, bolts, rivets, snap engagement and/or fittings or rolling. Thus, for example, an internal 32 or an external 31 part could have an open end, respectively outward or inward for fitting or snap engagement with a suitably shaped closed or even open end of the other between the external 31 or internal part 32.

As regards the realization of the two parts 31, 32, they could be made in the same or in a different and suitable material, such as for example, without any limitation, a metal, such as aluminum, for the external part 31 and polyamide, for the internal part 32.

With specific reference to the non-limiting embodiment illustrated in the figures, the external part 31 comprises, from the outside towards the inside, an external wing section 31*a*, partly enveloping one end of a respective edge of a panel 2, then a second section 31*b* defining a main seat 4*a*, if desired with the interposition of a third block section 31*c*, for example tubular, and an internal end 31*d*, if desired closed with connection protrusions 31*e*, 31*f* with the internal part 32 of the respective profile.

If desired, the external part 31 also defines an auxiliary seat 6 between the third projecting section 31*c* and the internal end 31*d*.

As regards in detail the inner end 31*d*, it has a main length 31*g*, for example extending in an direction orthogonal or transverse to the respective edge of a relative panel 2 and then one or two lateral connection protrusions 31*e*, each extending from an edge of the intermediate length 31*g* and then one or two central connecting protuberances 31*f*, if desired, two protrusions 31*f* extending from a central portion of the intermediate length 31*g* diverging moving away from the main length 31*g*.

As regards in detail the section with external wing 31*a*, it has a protruding portion 31*al* with respect to a respective edge of a panel and ending with a flanged section 31*a*2, if desired L-shaped, towards the outside and a portion enclosing 31*a*3 such edge and also ending with a flanged section 31*a*4, if desired in an L-shape, towards the outside.

On the other hand, with regard to the internal part 32, it has, from the inside outwards, a connection flap 32*a*, for example U-shaped, for fastening to a respective part of a panel 2, for example to a free end of a respective sheet 2*n* or of one or more protruding sections 2*p*2 thereof, then a second length 32*b* defining a main seat 4*a*, a third block length 32*c*, if desired tubular and an external end 32*d*, if desired open for engagement, for example snap or fitting or coupling with the internal end 31*d* of the first part 31 of the respective profile 30.

With specific reference to the non-limiting embodiment illustrated in the figures, the external end 32*d* comprises a C-shaped configuration open towards the outside or towards the internal end 31*d*, the lateral sections of the C defining for example one or more steps for the snap, fitting, enclosing or other engagement with the connection protrusions 31*e*, 31*f*.

In this regard, for the constraint of the two parts 31, 32 it is possible to insert the central connection protrusion/s 31*f* within the external end 32*d*, for example by fitting or snap-in or rolling and then suitably bend the lateral connection protrusion/s 31*e* close to respective portions of the outer end 32*d*.

Clearly, an inverse configuration to that described above could be obtained for internal 31*d* and external 32*d* ends.

According to the example of FIGS. 20 to 23, one of the sheets 2*m*, 2*n* has a protruding section 2*p*2 for housing or constraint of a respective part 31, 32 of the profile 3.

According to the non-limiting example shown in the figures, the internal sheet 2*n* has a protruding section 2*p*2 for engagement, for example for hooking with the connection flap 32*a*.

Clearly, alternatively both sheets 2*m*, 2*n* could have a protruding section for engagement, for example for hooking the respective connection fins of the parts 31, 32 or this could be provided only for the sheet 2*m* or for no sheet.

Some and preferably all the components of the parts 31, 32 extend for the entire length of the respective edge of the respective panel 2, so that the main seats 4*a*, 4*b* and any auxiliary seats 6 extend for the entire length or extension or perimeter of the respective profile 30.

Also in accordance with the embodiment now under consideration, at least one connection screw 11 is provided, passing through at least one panel 2 starting from the outside to the inside of the same and through the main frame 9 so as to fix the panel 2 to the main frame 9. For each panel 2, for example, two, three or more screws 11 can be provided and in any case in a number such as to satisfy the static coupling requirements, which screws are mounted at respective edge sections of the panel 2.

With reference to this aspect, the screw or each screw 11*a* can also pass through the outer wing portion 31*a*, if desired through the respective enclosing portion 31*a*3.

If desired, at least one auxiliary external profile 33 is also provided, preferably snap-fitted between the head 11*a* of a connection screw 11 and the external, in use, face of a respective sandwich panel 2 or better of a respective sheet 2*m*.

This profile is configured in a very similar way to the external auxiliary profile 12, then with a main plate with a series of protrusions extending from it, in use, towards the panel 2. These protrusions can be constrained, for example by snap engagement, with the flanged portions 31*a*2 and 31*a*4.

The external auxiliary profile 33, if provided, can be made of any suitable material, for example metal, such as aluminum or other material.

The constraint or connection between the parts 31, 32 of the profile 30 and a respective edge of a panel 2 can be ensured by a connecting screw 11 or also by means of screws, rivets or the like components 34.

With reference to the embodiment illustrated in the figures, the internal part 32 of the section 30 is riveted to the protruding part 2*p*2 of the internal sheet 2*n*. Clearly, according to other configurations, a connection screw 11 could be provided for fixing both parts 31, 32 or screws or rivets for connecting both parts 31, 32 of the profile 30 to the panel 2.

Alternatively, this connection or constraint can also be guaranteed by a snap or to size or forced fitting.

As for the gaskets 7*a*, 7*b*, they can be as described with reference to the embodiment of FIGS. 1 to 12.

If the gaskets 7*a*, 7*b* have wings 7*h*, 7*m*, they can have an extension in an external-internal direction different from each other or even the same.

In use, the tip 7*c* of each gasket 7*a*, 7*b* is fitted or inserted to size in a respective main seat 4*a*, 4*b*, while the wings 7*h*, 7*m*, if provided, abut, if desired with slight bending against a respective projecting component of one or both parts 31, 32.

A facade system according to the present invention was made with the aim of providing prefabricated modules for facades, for example opaque, which can, in a subsequent study and design phase, provide for the integration of windows.

As it will be possible to ascertain, the system aims to use a limited number of components, such as one or more profiles 3, for example cold formed, sandwich panels 2, if desired sheets 2, for example in plasterboard and a series of other profiles, for example made of PVC and gaskets for the perimeter sealing of these modules.

The approach followed is to provide a real integrated system, with off-site pre-assembly, which composes the entire element of the external envelope (exterior wall) with a load-bearing structure, for example made of steel, for example cold profiled, internal and external covering of the panel with sheets and panels and insulating material in the cavity, able to guarantee all the performances required in the energy, acoustic and seismic and fire safety fields as well as the water, air and wind tightness according to the European standard UNI EN 13830 Curtain walls—Product standard (EN 13830, 2015).

It will be understood how a system according to the present invention is adaptable and flexible for both dry covering and dry wrapping.

It is also possible to contain thermal bridges and integrate, if necessary, thermal breaks.

It also achieves the optimization of off-site prefabrication and reduction of on-site assembly operations.

An invention according to the present invention then allows the optimization of the disassembly of the system for recycling at the end of its life as well as the optimization of the adoption of low environmental impact materials to complete the stratigraphic package.

Thanks to the present invention, it is then possible to optimize the customization of the covering in terms of material and finishes as well as plant integration and dimensional adaptability, taking into account the facilitation of handling and installation operations on site, as well as transportability.

Changes and variants of the invention are possible within the scope defined by the claims.

The invention claimed is:

1. A prefabricated or pre-assembled module for obtaining an external wall for cladding buildings or for obtaining a curtain wall, including:

at least one sandwich panel defining two main faces, an upper, in use, edge, a lower, in use, edge and two lateral edges, at least four edge profiles, each mounted on a respective edge of said at least one sandwich panel, each of said at least four edge profiles delimiting at least one main seat extending for the entire extension of each of said at least four edge profiles, at least three gaskets, each mounted within said at least one main seat of a respective edge profile and extending therefrom for the engagement of an adjacent module, at least one gasket having a length substantially equal to the length of a respective edge of said at least one sandwich panel on which a respective profile is mounted, and further comprising, in a direction from an outside towards an inside starting from a unit including said at least one sandwich panel and said at least four edge profiles mounted on a respective edge of said at least one sandwich panel, at least one main frame fixed to said unit by means of screws, bolts and/or rivets, wherein the at least one main frame comprises four frame sections defining a perimeter frame having vertical frame sections and horizontal frame sections, wherein each, vertical frame section is in contact and constrained at respective ends with each horizontal frame section.

2. The prefabricated or pre-assembled module according to claim 1, wherein said at least one sandwich panel comprises a first main supporting or insulating block as well as at least one first sheet applied or adhered to at least one external, in use, face of the first block and at least one second sheet applied or adhered to the other internal, in use, face of the first block.

3. The prefabricated or pre-assembled module according to claim 2, wherein at least one among said first and said second sheet protrudes for a protruding section laterally with respect to the first block and wherein said at least one edge profile is mounted or fitted or inserted at said protruding section or between the protruding sections of said sheets.

4. The prefabricated or pre-assembled module according to claim 1, comprising screws, bolts and/or rivets for fixing said at least one edge profile to said sandwich panel.

5. The prefabricated or pre-assembled module according to claim 1, wherein said at least one edge profile comprises a base plate and one or more projecting components designed to define said at least one main seat, and wherein said base plate is designed to be installed in use parallel to a respective edge of the sandwich panel, while the projecting components extend from the base plate moving away and/or approaching a respective first block of the sandwich panel.

6. The prefabricated or pre-assembled module according to claim 5, wherein said at least one edge profile comprises at least three projecting components defining between them two main seats.

7. The prefabricated or pre-assembled module according to claim 6, wherein said at least one edge profile, from an outside towards an inside, comprises a front or external projecting component, at least one intermediate projecting component delimiting a first main seat with the front or external projecting component, and a rear or internal projecting component delimiting a second main seat with said at least one intermediate projecting component.

8. The prefabricated or pre-assembled module according to claim 7, wherein a first intermediate projecting component is provided which delimits a first main seat with the front or external projecting component, and a second intermediate projecting component at a distance from the first intermediate projecting component so as to define with it at least one auxiliary seat and a second main seat with said rear or internal projecting component.

9. The prefabricated or pre-assembled module according to claim 5, wherein said at least one edge profile comprises projecting components starting from a side of the base plate proximal, in use, to the first block or facing it.

10. The prefabricated or pre-assembled module according to claim 1, wherein said at least one edge profile, at a respective external and/or internal end or side comprises connection/finishing fins for constraint to a respective part of the sandwich panel.

11. The prefabricated or pre-assembled module according to claim 1, wherein said at least one gasket comprises a tip designed to be inserted or fitted in a respective main seat and a tail protruding for engagement with respective sections or gaskets of adjacent modules.

12. The prefabricated or pre-assembled module according to claim 5, wherein said at least one gasket comprises a tip designed to be inserted or fitted in a respective main seat and a tail protruding for engagement with respective sections or gaskets of adjacent modules, and wherein said tail is designed to abut with respective projecting components extending from the side of the base plate distal from the first block of the respective panel.

13. The prefabricated or pre-assembled module according to claim 11, wherein said tip is tapered away from the tail and has first dovetail portions.

14. The prefabricated or pre-assembled module according to claim 11, wherein said tail comprises second dovetail portions with a first enlarged portion and then a V or U section with section increasing moving away from the tip.

15. The prefabricated or pre-assembled module according to claim 11, wherein said at least one gasket comprises wings extending, one towards an outside and the other towards an inside, starting from a zone between a rear and the tip moving away from a main body of the tail, and wherein said wings rest against a respective component of said at least one edge profile.

16. The prefabricated or pre-assembled module according to claim 1, comprising at least one connection screw passing through at least one sandwich panel starting from the outside to the inside of the same and through the main frame so as to fix said at least one sandwich panel to the main frame.

17. The prefabricated or pre-assembled module according to claim 1, wherein said at least one edge profile is made by two or more parts connected to each other.

18. The prefabricated or pre-assembled module according to claim 17, wherein said parts have an open end, respectively outward or inward for fitting or snap engagement with a closed end or also with an open end on the other part.

19. The prefabricated or pre-assembled module according to claim 1, wherein said module is assembled or can be assembled before being mounted or anchored or constrained to a wall or to other walls or slabs of a building and also before being constrained or fixed to others modules for obtaining a curtain wall or facade, so that it can be moved and mounted on site as a single piece or a single component.

20. A group for obtaining or covering a wall comprising at least two prefabricated modules placed side by side or placed one above the other and with respective gaskets in sealing engagement, each module comprising:

at least one sandwich panel defining two main faces, an upper, in use, edge, a lower, in use, edge and two lateral edges, at least one edge profile mounted on a respective edge of said at least one sandwich panel, said at least one edge profile delimiting at least one main seat extending for the entire extension of said at least one edge profile, at least one gasket, mounted within said at least one main seat of a respective edge prof ile and extending therefrom for the engagement of an adjacent module, said at least one gasket having a length substantially equal to the length of a respective edge of said at least one sandwich panel, i.e. of the edge on which a respective edge profile is mounted, wherein said at least one edge profile mounted in the upper edge of the panels is kept without the gasket before mounting or assembling more modules, while in the same a continuous gasket is inserted, said continuous gasket extending for two or more modules placed side by side horizontally, and wherein said continuous gasket comprises a main plate on one side of which at least one tip portion extends, while on the other side at least one tail portion extends and a protuberance is then provided extending from the same side as the tail portion, but with extension greater than the latter, said at least one tip portion being mounted in at least one main and/or auxiliary seat of an edge profile of at least one lower module, said protuberance having the respective free end mounted within an auxiliary seat of an upper module, while said at least one tail portion is in sealing engagement with the tail of at least one gasket of an upper module.

21. The group according to claim 20, wherein said at least one gasket mounted within a seat of a profile mounted on a first sandwich panel of a first module is in sealing engagement for its entire length with a gasket mounted within a seat of a profile mounted on a second sandwich panel of a second module adjacent to the first.

* * * * *